United States Patent [19]

Yoerger

[11] 4,119,460

[45] Oct. 10, 1978

[54] $\pi$-DEFICIENT N-HETEROAROMATIC CHEMICAL SENSITIZERS FOR HETEROGENEOUS ORGANIC PHOTOCONDUCTOR COMPOSITIONS AND METHODS

[75] Inventor: William E. Yoerger, Rochester, N.Y.

[73] Assignee: Eastman Kodak Company, Rochester, N.Y.

[21] Appl. No.: 800,587

[22] Filed: May 25, 1977

[51] Int. Cl.[2] ..... G03G 5/04; G03G 5/09

[52] U.S. Cl. ..... 96/1 PC; 96/1.5 R; 96/1.6

[58] Field of Search ..... 96/1.5, 1.6, 1 PC

[56] References Cited

U.S. PATENT DOCUMENTS

| | | | |
|---|---|---|---|
| 3,152,895 | 10/1964 | Tinker et al. | 96/1.5 |
| 3,279,918 | 10/1966 | Cassiers et al. | 96/1.5 |
| 3,287,123 | 11/1966 | Hoegl | 96/1.5 |
| 3,518,082 | 6/1970 | Chiecchi | 96/1.6 X |
| 3,607,261 | 9/1971 | Amidon et al. | 96/1.8 |
| 3,870,516 | 3/1975 | Smith et al. | 96/1.5 |
| 3,904,407 | 9/1975 | Regensburger et al. | 96/1.5 |

FOREIGN PATENT DOCUMENTS

| | | | |
|---|---|---|---|
| 1,289,529 | 9/1972 | United Kingdom | 96/1.5 |

OTHER PUBLICATIONS

Albert, "Heterocyclic Chemistry, An Introduction," Chap. IV, U. of London), Athlone Press, 1959.

*Primary Examiner*—Roland E. Martin, Jr.
*Attorney, Agent, or Firm*—Torger N. Dahl

[57] ABSTRACT

Photoconductive insulating compositions in the form of organic photoconductive dispersions are described. Particles of organic photoconductor such as p-terphenyl are dispersed in cellulose nitrate and chemically sensitized with $\pi$-deficient N-heteroaromatic compounds such as quinoxalines to provide useful heterogeneous photoconductive insulating dispersions. Such dispersions can be applied to an electrically conducting support to prepare electrophotographic elements.

21 Claims, No Drawings

π-DEFICIENT N-HETEROAROMATIC CHEMICAL SENSITIZERS FOR HETEROGENEOUS ORGANIC PHOTOCONDUCTOR COMPOSITIONS AND METHODS

BACKGROUND OF THE INVENTION

1. Field of the Invention

This invention relates to electrophotography. In particular, the invention relates to chemical sensitization of heterogeneous photoconductive compositions and electrophotographic elements with heteroaromatic compounds in which nitrogen is the sole hetero atom.

2. Discussion of Related Art

The process of xerography, as disclosed by Carlson in U.S. Pat. No. 2,297,691 (issued Oct. 6, 1942), employs an electrophotographic element comprising a support material bearing a coating of a normally insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor, or the like, or transferred to a second element to which it can similarly be fixed. Likewise, the electrostatic latent image can be transferred to a second element and developed there.

Various photoconductive insulating materials have been employed in the manufacture of electrophotographic elements. For example, vapors of selenium and vapors of selenium alloys deposited on a suitable support, and particles of photoconductive zinc oxide dispersed in resinous, film-forming binder have found wide application in the present-day document copying applications.

Since the introduction of electrophotography, a great many organic compounds have also been screened for their photoconductive properties. As a result, a very large number of organic compounds have been shown to possess some degree of photoconductivity. Many organic compounds have revealed a useful level of photoconduction and have been incorporated into photoconductive compositions.

In photoconductive insulating compositions using organic photoconductors, the photoconductor, if not polymeric, is usually carried in a film-forming binder. Typical binders are polymeric materials having fairly high dielectric strength such as phenolic resins, ketone resins, acrylic ester resins, polystyrenes and the like. A more comprehensive listing of binders appears in U.S. Pat. No. 3,755,310 (issued Aug. 28, 1973 to L. J. Rossi). The photoconductor can be dissolved with the binder to prepare a homogeneous photoconductive composition in a common solvent. Or, it can be provided as a dispersion of small particles in the binder to prepare a heterogeneous photoconductive composition. A general discussion of such dispersions and their preparation appears in U.S. Pat. No. 3,253,914 (issued May 31, 1966 to G. Schaum). There is no suggestion in the U.S. Pat. No. 3,253,914 of binders that are especially useful for preparing the dispersions.

Organic photoconductors demonstrate widely varying degrees of solubility in the organic solvents used to dissolve many of the common binders. In the preparation of homogeneous photoconductive insulating compositions, organic photoconductors such as p-terphenyl and others of low solubility in popular solvents cannot usually be included in sufficient concentration to provide compositions of desirable light-sensitivity. By use of dispersion techniques such as those used with zinc oxide photoconductors, heterogeneous photoconductive insulating compositions having higher concentrations of low solubility photoconductors can be obtained, the objective being to improve light-sensitivity in the composition.

Heterogeneous organic photoconductive compositions as discussed herein can be advantageous, especially in the preparation of electrophotographic elements on which visible images will be provided. For example such elements are both lighter in weight than those having inorganic photoconductors like zinc oxide, and can be prepared to resemble bond paper. However, in such applications they have not enjoyed the popularity of photoconductive insulating compositions using inorganic photoconductors. This is largely due to the unacceptable photoconductivity (or speed) of such heterogeneous compositions despite high concentrations of organic photoconductor. Homogeneous compositions of organic photoconductors, on the other hand, appear to be acceptable in their photoconductivity, but when coated on paper materials, they do not have the appearance and feel of plain paper.

To improve the photoconductivity of heterogeneous photoconductive compositions comprising dispersed organic photoconductor particles, a variety of compounds have been studied for use as so-called chemical sensitizers or activators. When added to the photoconductive compositions it is intended that such compounds enhance the photoconductivity of the composition at least within the electromagnetic wavelength region in which the composition is intrinsically sensitive. If successful, the composition is said to be chemically sensitized or activated. Owing to the commercial popularity of homogeneous photoconductive compositions, however, the art has, for the most part, taught chemical sensitizers which are specific to homogeneous compositions. In this regard, it does not generally follow that a chemical sensitizer that is useful in a homogeneous mode, is also useful in a heterogeneous mode. Also, as is the case in the present invention, the binder employed in a heterogeneous photoconductive insulating composition can affect not only the photoconductivity of the composition, (see U.S. Pat. No. 3,703,372, issued Nov. 21, 1972 to S. H. Merrill) but also can affect the ability of the composition to be chemically sensitized.

In U.S. Pat. Nos. 3,152,895 (issued Mar. 14, 1962 to G. H. Tinker et al) and 3,607,261 (issued Apr. 4, 1969 to A. B. Amidon) a variety of binders, including cellulose nitrate, are disclosed for use in photoconductive compositions comprising either inorganic or organic photoconductors. Neither of these patents, however, provide any specific teaching as to sensitization with compounds of the present invention nor any suggestion that the ability of a photoconductive composition to be sensitized may be affected by the binder employed.

N-heteroaromatic compounds of the type disclosed herein have been previously used in the field of electrophotography. See, for example, U.S. Pat. No. 3,279,918 issued Oct. 18, 1966 to P. M. Cassiers et al; British Pat. No. 1,289,529 published Sept. 20, 1972 issued to Canon Kabushiki Kaisha. These patents, however, neither point out nor suggest the use of such compounds with any particular binder to provide usefully sensitized heterogeneous compositions of dispersed organic photoconductor particles.

Selection of a proper chemical sensitizer is further complicated by other requirements of an electrophotographic process. An element employing a chemically sensitized photoconductive composition as defined herein must, for example, readily accept and hold electrostatic charge before imagewise illumination. Often compositions employing compounds screened for use as sensitizers, although acceptably photoconductive, fail to accept a sufficiently high charge to be useful in a practical sense. Compositions exhibiting such failure are said to be "charge saturated". Further, though able to accept charge, compositions may be unable to hold applied charge for reasonable periods of time in the dark hence the term "dark decay".

SUMMARY OF THE INVENTION

In accordance with this invention, a heterogeneous photoconductive insulating composition comprising particles of an organic photoconductor dispersed in a cellulose nitrate binder is sensitized by using "$\pi$-deficient N-heteroaromatic" compounds, as described in greater detail hereinafter. Compositions so sensitized readily accept electrostatic charge and substantially avoid dark decay. The $\pi$-deficient compounds employed in this invention are preferably substituted with electron-withdrawing groups.

When electrophotographic elements are prepared by applying the photoconductive insulating dispersions of this invention to a conducting paper support, the photoconductive layer can be white and resemble bond paper in both appearance and feel. This is in contrast to many photoconductive papers using an inorganic species, such as a metal oxide, as the photoconductor. Further (apparently because of the particulate nature of the photoconductor, which may provide an increase in photoconductor surface area) the present compositions and elements can be chemically and spectrally sensitized with low concentrations of sensitizer compounds compared to the concentrations that may be required for homogeneous compositions. This sensitization capability permits enhancement of the spectral response and electrophotographic speed of the particular photoconductor without detracting from the desired color of photoconductive compositions and electrophotographic elements described herein.

DETAILED DESCRIPTION OF THE PREFERRED EMBODIMENTS

The present invention provides chemical sensitization of heterogeneous photoconductive insulating compositions having particles of an organic photoconductor dispersed in a cellulose nitrate binder. To this end, $\pi$-deficient N-heteroaromatic compounds are included in sensitizing amounts in the aforesaid photoconductive compositions.

The term "$\pi$-deficient N-heteroaromatic compound", as used herein, signifies a class of unsaturated heterocyclic compounds generally recognized in the chemical arts in which nitrogen is the sole hetero element. The nitrogen in the aromatic nucleus of such compounds is believed to attract electrons from the aromatic $\pi$-double layer to cause an electron deficiency therein. While this is only a theoretical assumption and not intended to limit the invention described herein, such deficiency of electrons is believed to contribute to chemical sensitization of heterogeneous photoconductive compositions of this invention. Detailed information regarding $\pi$-deficient N-heterocyclic compounds can be found in Adrien Albert, *Heterocyclic Chemistry, An Introduction,* Chapter IV (University of London, The Athalone Press, 1959). Typical $\pi$-deficient N-heteroaromatic compounds are, for example, pyridines, pyrimidines, quinolines, pyridazines, pyrazines, phenazines, quinoxalines and the like; or benzologs of any of these ("benzologs" referring to the presence of one or more benzene rings fused to the parent compound).

The present $\pi$-deficient N-heteroaromatic compounds preferably include electron withdrawing substituents such as halo, nitro, carboxyl, carbonyl, cyano, fluorosulfonyl, and the like. Especially useful results can be obtained when the substituent is halo, nitro, or carbonyl.

Most preferred chemical sensitizers for use in accordance with the invention are quinoxalines substituted with from 1 to 4 halo groups. For example, 2,3,6-trichloroquinoxaline provides, among other things, particularly good electrophotographic speeds when used as described herein.

Representative chemical sensitizers that can be used in accordance with the invention include: pyridine, 2,3,6-trichloroquinoxaline, pyrimidine, 2,3,6,7-tetrachloroquinoxaline, quinoline, 2,3-dichloro-6,7-dinitroquinoxaline, pyridazine, 2-chloro-3,5-dinitropyridine, pyrazine, 5-chloro-{a}phenazine, phenazine, 4,7-dichloroquinoline, quinoxaline, 2,6-dichloropyrazine, 3,6-dichloropyridazine, 2-chlorobenzo{b}phenazine-6,11-dione, 2,4,6-trichloropyrimidine, 2-chloroquinoxaline, 2,4-dichloropyrimidine, 4,6-dichloro-5-nitropyrimidine, 2,3-dichloroquinoxaline, 2,6-dichloropyridine, 2-chloro-3-methylquinoxaline, 2,6-diobromopyridine, 2,3-diphenylquinoxaline, 1-chloro-4-nitroisoquinoline.

$\pi$-deficient N-heteroaromatic chemical sensitizers, as described above, increase the photoconductivity of heterogeneous photoconductive insulating compositions comprising particles of an organic photoconductor dispersed in cellulose nitrate binder. Such compositions, moreover, accept and retain useful levels of electrostatic charge in the dark until subsequent illumination dissipates the retained charge in an imagewise manner.

In contrast to the results achieved herein, photoconductive compositions comprising the sensitizers described above with organic photoconductors dispersed in binders other than cellulose nitrate, for example, acrylic polymers, exhibit a level of photoconductivity which is substantially the same as the composition without sensitizer. (see Example 28 below).

In another embodiment of the invention, the present $\pi$-deficient N-heteroaromatic chemical sensitizers can be substituted with styryl groups. Such substitution can be particularly advantageous. Thus, when the resulting chemical sensitizer is employed in heterogeneous compositions containing certain organic photoconductors, particularly anthracene, the composition is not only chemically sensitized, but also spectrally sensitized into the blue region of the electromagnetic spectrum (anthracene compositions are intrinsically sensitive only to ultraviolet wavelengths). Accordingly, the $\pi$-deficient heteroaromatic chemical sensitizers described herein are preferably substituted with at least one styryl group. Suitable styryl groups include unsubstituted as well as substituted styryls, preferably alkoxystyryls such as acetoxystyryl, methoxystyryl, and the like. Most preferably, quinoxaline $\pi$-deficient compounds with the aforementioned styryl substituents are employed.

Photoconductive insulating compositions of the present invention include cellulose nitrate as a polymeric binder and, dispersed in the binder, organic photoconductive particles. The cellulose nitrate that is used as a binder can vary greatly in such factors as molecular weight and nitrogen content. Cellulose nitrates having a nitrogen content of up to about 13 weight percent as shown by elemental analysis are preferred. Cellulose nitrate having a nitrogen content of from about 11.5 to about 13 percent is especially preferred. A wide range of cellulose nitrates, at different viscosities and different nitrogen contents, is available. Many such materials are discussed in *Nitrocellulose, Properties and Uses,* Hercules Powder Co., (1955). The binder should be soluble in a solvent or solvent mixture that has little or no solvent action on the organic photoconductor. Alcohol soluble cellulose nitrate is preferred, such as that which exhibits appropriate solubility in lower alcohols like methanol.

A wide range of particulate organic photoconductors can be used together with cellulose nitrate binder in preparing the present photoconductive insulating compositions. Organic photoconductors that can be provided in particulate form are illustrated in Volume 109 of *Research Disclosure* at Section IVA of Index No. 10938, pp. 62 and 63 (published May, 1973 by Industrial Opportunities, Ltd., Homewell, Havant, Hampshire, PO9 1EF, United Kingdom).

Especially useful photoconductors are microcrystalline photoconductive particles of aromatic compounds containing a plurality (i.e., 2 or more) of fused or unfused aromatic rings, preferably aromatic carbocyclic rings containing 6 ring carbon atoms. In particular, microcrystalline particles of (a) fused carbocyclic ring compounds (b) polyphenyl compounds having the formula

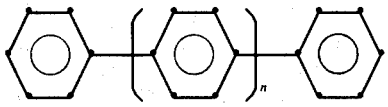

(I)

wherein $n$ is an integer of from 1 to about 6; and (c) nitrogen-free, polyarylated aliphatic compounds having the formula

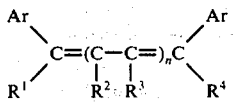

(II)

wherein $n$ represents a number having a value of 0, 1 or 2;

Ar represents an aryl group, including substituted aryl, such as phenyl, alkylphenyl having 1 to about 10 carbon atoms in the alkyl moiety (e.g., ethylphenyl, octylphenyl or tert-butylphenyl) and alkoxyphenyl having 1 to about 10 carbon atoms in the alkoxy moiety (e.g., methoxyphenyl, propoxyphenyl or decoxyphenyl);

each of $R^1$, $R^2$, $R^3$ and $R^4$ represents a hydrogen atom, and aryl group (for example as defined for Ar), an alkyl group having 1 to about 10 carbon atoms, or an alkoxy group having 1 to about 10 carbon atoms. When $n$ is 0, both $R^1$ and $R^4$ are aryl and, when both $R^1$ and $R^4$ are hydrogen, both $R^2$ and $R^3$ are aryl.

Preferred fused carbocyclic ring-containing compounds (i.e., type (a) compounds noted above) for making microcrystalline photoconductive particles used in the present invention include naphthalene, anthracene, etc., preferably athracene.

Preferred polyphenyl compounds, i.e., type (b) compounds noted, for making microcrystalline photoconductive particles include polyphenyl compounds of formula I above wherein the phenylene groups are para-phenylene groups. Such compounds include, for example, p-terphenyl, p-quaterphenyl, and p-sexiphenyl. Especially preferred materials are co-crystalline photoconductors comprising p-terphenyl doped with p-quaterphenyl. Techniques for manufacturing such photoconductors include, for example, dissolving p-terphenyl and p-quaterphenyl in a common solvent, and thereafter co-crystallizing the dissolved polyphenyls, as described in copendng application U.S. Ser. No. 800,509 entitled CO-CRYSTALLINE PHOTOCONDUCTORS AND HETEROGENEOUS COMPOSITIONS THEREOF in the name of W. E. Yoerger filed concurrently herewith.

Preferred nitrogen-free, polyarylated photoconductors have the formula:

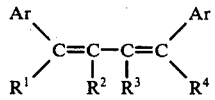

(III)

wherein each Ar and $R^1$, $R^2$, $R^3$ and $R^4$ are as described above.

Impurities in the photoconductor may affect its performance in compositions of the present type and usually samples of somewhat high purity are preferred. It will also be appreciated that photoconductors useful in the present invention, such as type (a), (b), and (c) compounds noted hereinbefore, can include substituent groups, not specified herein, which do not impair image-forming properties of the photoconductor.

Table I lists representative photoconductors that are useful in the practice of this invention.

TABLE 1

| | |
|---|---|
| Tetraphenylpyrrole | Tetraphenylethylene |
| Anthracene | 1,4-Diphenyl-1,3-butadiene |
| Phenanthrene | 1,1,4-Triphenylbutadiene |
| Pyrene | 1,1,4,4-Tetraphenyl-1,3-butadiene |
| p-Terphenyl | 1,2,3,4-Tetraphenyl-1,3-butadiene |
| p-Quaterphenyl | 1,6-Diphenyl-1,3,5-hexatriene |
| p-Sexiphenyl | |

Sensitizers in addition to the $\pi$-deficient N-heteroaromatic compounds described can be included in the present photoconductive insulating compositions. Useful sensitizers include spectral sensitizers, which are intended primarily to make the photoconductor light-sensitive to spectral regions not within the region of its inherent sensitivity; and chemical sensitizers that serve primarily to increase light-sensitivity of the photoconductor in the spectral region of its inherent sensitivity as well as in those regions to which it may have been spectrally-sensitized.

Representative chemical sensitizers include polymeric sensitizers having monovalent side groups of the chlorendate radical, such as polyvinylchlorendate and others described in greater detail in copending U.S. Patent Application Ser. No. 800,594 entitled POLYMERIC CHEMICAL SENSITIZERS FOR ORGANIC PHOTOCONDUCTIVE COMPOSITIONS by J. M. McCabe et al and filed concurrently herewith; hexachlorocyclopentene chemical sensitizers in combination with cellulose nitrate as described in copending U.S. Patent Application Ser. No. 800,483 entitled HEXACHLOROCYCLOPENTENE CHEMICAL SENSITIZERS FOR HETEROGENEOUS ORGANIC PHOTOCONDUCTIVE COMPOSITIONS by W. E. Yoerger and filed concurrently herewith. Other chemical sensitizers include mineral acid; carboxylic acids such as maleic, di- and trichloroacetic acids, and salicyclic acids; sulfonic acids and phosphoric acids; and electron acceptor compounds as disclosed by H. Hoegl in *J. Phys. Chem.*, 69, No. 3, pages 755–766 (March, 1965) and in U.S. Pat. No. 3,232,755.

Spectral sensitizers can be included in the present photoconductive insulating compositions, which are intended primarily to make the photoconductor light-sensitive to spectral regions not within the region of its inherent sensitivity. Spectral sensitizers can be chosen from a wide variety of materials such as pyrylium dye salts inclusive of thiapyrylium and selenapyrylium dye salts such as those described in U.S. Pat. No. 3,250,615 (issued May 10, 1966 to C. C. Natali et al); the benzopyrylium or benzothiapyrylium type sensitizers described in U.S. Pat. No. 3,554,745 (issued Jan. 12, 1971 to J. A. Van Allan); and defensive publication No. T-889,023 (published Aug. 31, 1971 to G. A. Reynolds et al); or the cyanine, merocyanine or azacyanine dyes described in U.S. Pat. No. 3,597,196 (issued Aug. 3, 1971 to C. J. Fox et al).

Preferred spectral sensitizers for use with the present photoconductive compositions include the benzothiapyrylium dye cation 4-(thiaflavyl id ylmethylene) flavylium and/or the cyanine dye cation 1,3-diethyl-2-{2-(2,3,4,5-tetraphenyl-3-pyrrolyl)vinyl}-1H-imidazo{4,5-b}quinoxalinium.

In compositions of this invention, the present heteroaromatic sensitizers are usually included in amounts of about 0.5% to about 10%, by weight, of photoconductor. Spectral sensitizers are usually present in the composition in amounts of about 0.001% to about 0.1% by weight, of photoconductor. Wider ranges can be useful. In the case of spectral sensitizers, however, unduly high concentrations produce color that is apparent to the eye and undesirably affect the appearance of compositions that are intended to provide a white background.

Matting agents are usefully included in the present photoconductive insulating compositions. A matting agent tends to avoid glossiness that might otherwise be obtained in layers prepared using the subject compositions and thereby enhance the "plain paper" appearance and feel that can characterize electrophotographic elements of this invention that use a paper support. Further, matting agents can improve the capability of such layers to receive legibly information written or otherwise marked on the layer. Matting agents are preferably electrically inert and hydrophobic, so as not to interfere with chargeability, charge retention or other parameters affecting electrophotographic imaging. Methacrylate and polyethylene beads are described in U.S. Pat. No. 3,810,759 (issued May 14, 1974 to T. H. Morse et al) as matting agents. Hydrophobic silicon containing materials are described as matting agents in U.S. Pat. No. 3,652,271 (issued Mar. 28, 1972 to D. M. Bornarth). An especially preferred silicon based matting agent is an inorganic oxide pigment, such as fumed silicon dioxide, that has been chemically modified to render it hydrophobic by reaction with an organic compound like a silane to substitute hydrocarbylsilyl or other hydrophobic groups for the hydroxyl groups originally on the silicon dioxide chain. The fumed silica or other inorganic oxide pigment can be reacted conveniently with an appropriate silane, such as a halotrialkylsilane, merely by contact in solution. A preferred silane is chlorotrimethylsilane and incorporation of the silane in an amount of about 5 to about 15%, by weight, of the inorganic pigment is especially desirable. It is considered that other inorganic pigments like titanium dioxide and aluminum oxide, as well as clays, could be modified similarly by reaction with a silane to provide useful matting agents. Matting agents can be employed in a wide range of particle sizes and concentrations to provide the desired degree of surface texture. It is also well known in the art to consider the thickness of the photoconductive layer in relation to the matting agent particle size when selecting matting agent. See, for example, the aforementioned U.S. Pat. No. 3,652,271, and U.S. Pat. No. 3,519,819, issued July 7, 1970 to E. P. Gramza et al. It should be emphasized that such matting agents can be used to advantage in a wide range of homogeneous and heterogeneous photoconductive insulating compositions.

Photonconductive insulating compositions of the present invention can be prepared merely by dispersing photoconductor having the desired particle dimensions in a solution of the cellulose nitrate binder that contains a heteroaromatic sensitizer as described herein and also any other constituents e.g., spectral sensitizers, matting agents, etc., to be included in the composition. As mentioned elsewhere herein, the solvent for the binder should not have solvent action with respect to the photoconductor, which desirably is not dissolved or swollen by the binder solvent. After addition of the particulate photoconductor, the heterogeneous composition is usually stirred or otherwise mixed thoroughly to assure reasonable uniformity of the dispersion. Photoconductors used in practicing this invention desirably have a maximum particle diameter ranging from about 0.1 micron to about 20 microns with from about 0.1 micron to about 10 microns being preferred. If the photoconductor has not been ball-milled or otherwise processed to an appropriate particle size prior to its dispersion in the binder, a heterogeneous composition of the invention can be prepared and thereafter agitated in the presence of stainless steel balls or other materials effective to produce a milling action that causes attrition in the particle size of the photoconductor.

In the alternative, the photoconductor can be dispersed and ball-milled in a non-solvent that is a solvent for the cellulose nitrate binder and heteroaromatic sensitizer of choice. Sensitizers to be included in the composition can be added to the photoconductor dispersion prior to such ball-milling. After this first ball-milling stage, the binder can be added, usually in the form of a solution. The composition is preferably again milled to obtain a uniform dispersion.

In the present compositions, the photoconductor is desirably included in an amount of at least about 40% (by weight of solids in the composition) and may range to 95 weight percent and higher depending on the particular application. Generally, the binder need only be present in an amount sufficient to provide adhesion between particles in the composition and between the composition and the support, if used. Typically, the cellulose nitrate can be present in the composition in an amount from about 5 percent to about 40 percent, by weight, of solids in the composition. In various preferred embodiments, the photoconductor and any sensitizers, matte agents or other adjuvants constitute between about 70 and 90%, by weight, of solids in the composition, with the binder or binders making up the remainder of the composition. In certain instances, photographic speed may diminish with photoconductor concentrations of less than about 60 weight percent.

As indicated above, the photoconductive insulating composition is usually prepared as a solution of the binder containing other components of the composition including dispersed photoconductive particles. In such form, the composition can be formed into a self-supporting member or it can be coated on an electrically conducting support to provide an electrophotographic element. For purposes of coating, the compositions desirably range from about 20 weight percent solids to about 40 weight percent solids. If extrusion hopper coating is to be used, the most useful solids content of the composition is usually between about 20 and 30 weight percent. For doctor blade coating, from about 30 to about 40 weight percent solids is preferred. Wider ranges may be appropriate depending on conditions of use. In preparing the compositions for purposes such as ball milling and coating, it may be desirable to use a solvent blend to provide optimal viscosity, ease of solvent removal or the like. Acetonitrile can be desirable in combination with methanol to provide a solvent mixture for the cellulose nitrate binders discussed herein.

While it is preferable to use cellulose nitrate as sole binder with the heteroaromatic compounds described above, it may also be desirable to employ cellulose nitrate in combination with other insulating resins as co-binders in the present compositions. If so desired, such other resins must be compatible with and dissolve in the solvent employed to dissolve cellulose nitrate when forming the aforesaid compositions. Furthermore, the inclusion of resins in addition to cellulose nitrate must not interfere with the ability of the described heteroaromatic compounds to chemically sensitize, as described in accordance with the invention. Suitable other resins can include conventional film-forming materials.

The photoconductive insulating composition is applied to a surface or support by any suitable means, such as extrusion hopper, doctor blade or whirler coating apparatus, at a coverage sufficient to provide a layer of from 10 to about 25 microns thick when dry, although layers of lesser or greater thickness can be used, if desired. The dry thickness for any given wet thickness as coated will depend in part on the size of the photoconductive particles in the composition and on the amount of void volume, if any, in the layer. Coverages of from about 2 to about 15 grams per square meter of support are often used.

Suitable supporting materials on which can be coated photoconductive layers comprising the photoconductive compositions described herein include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum, electrically conducting metals intermixed with protective inorganic oxides, such as Cr intermixed with SiO (as described in U.S. Pat. No. 3,880,657 issued Apr. 29, 1975 to A. A. Rasch) and the like coated on paper or conventional photographic film bases such as cellulose acetate, polystyrene, polyester, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are desribed in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such conducting layers and methods for their preparation and use are disclosed in U.S. Pat. No. 3,007,901 by Minsk, issued Nov. 7, 1961 and U.S. Pat. No. 3,262,807 by Sterman et al, issued July 26, 1966. Another useful support is paper or other fibrous material having thereon, to enhance electrical properties of the support, an electrically conducting material as described in U.S. Pat. No. 3,814,599 (issued June 4, 1974 to D. A. Cree).

Photoconductive compositions according to the present invention can be employed in electrophotographic elements useful in any of the well known electrophotographic processes which require photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductor layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young, issued Mar. 26, 1957; 2,786,440 by Giaimo, issued Mar. 26, 1957; 2,786,441 by Young, issued Mar. 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review", Volume 15 (1954), pages 469–484.

Because the electrophotographic elements described herein can be developed in a liquid environment, as above described, the non-photoconductive surface of the element, i.e., that side of the support opposite the side carrying the photoconductive layer, can be overcoated with a so-called solvent hold-out layer. One or more of these layers serve to reduce or eliminate penetration of solvent or liquid carriers into the paper support during development. A typical hold-out layer can include pigments, pigment dispersing agents, clays, latices such as styrene-butadiene latex, polyvinylalcohol, and the like, in various proportions to give the desired result.

H and D electrical speeds to indicate the photoconductive response of electrophotographic materials such as those discussed herein can be determined as follows: The material is electrostatically charged under, for example, a corona source until the surface potential, as measured by an electrometer probe, reaches some suitable initial value $V_o$, typically from 100 to about 600 volts. The charged element is then exposed to a 3000° K tungsten light source of a 5750° Xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the initial surface potential $V_o$ to any fixed selected value typically $\frac{1}{2}$ $V_o$. An apparatus useful for determining the electrophotographic speeds of photoconductive compositions is described in Robinson et al, U.S. Pat. No. 3,449,658, issued June 10, 1969.

In the alternative, relative sensitivity of electrophotographic materials above described can be determined by following the above procedure and thereafter calculating, in accordance with known techniques, the number of ergs per centimeter required to reduce the surface charge from $V_o$ to a preselected value lower than $V_o$.

Each of the above procedures were employed in the following examples, as indicated. Such examples are included to illustrate the present invention.

EXAMPLES 1–22

Photoconductive insulating compositions including 5.7 g. anthracene (Aldrich Chemical Co.), 2.1 g. cellulose nitrate (grade RS $\frac{1}{4}$ sec supplied as 70 percent solids in isopropanol by Hercules Powder Company), the chemical sensitizer in the concentration shown in Table I below (percentage being based on weight of anthracene present), and 10 ml. of methanol were each placed in vials containing 35 g. of 3.0 mm stainless steel milling media and milled for 2 hours by being shaken on a reciprocating paint shaker. 9 ml. methanol were added to the resulting dispersions. The resultant compositions were each coated at a wet thickness of about 0.1 mm on an electrically conducting support and dried to prepare electrophotographic elements. An otherwise identical control element without chemical sensitizer was prepared in the same manner. Each of the electrophotographic elements was charged to +100 volts and thereafter exposed to 400 nm light source for a time sufficient to discharge exposed regions to +10 volts. With the electrical sensitivity of the control element arbitrarily designated 1.0 erg per centimeter to discharge the coating to +50 volts, the relative sensitivities of the chemically sensitized elements were as shown in Table I.

TABLE I

| Example | Chemical Sensitizer | Concentration (%) | Relative Sensitivity (erg/cm) |
|---|---|---|---|
| | None (control) | — | 1.00 |
| 1 | 2,4,5,6-tetrachloropyrimidine | 10 | 0.46 |
| 2 | 4,7-dichloroquinoline | 10 | 0.63 |
| 3 | 3,6-dichloropyridazine | 10 | 0.59 |
| 4 | 2-chloro-3,5-dinitropyridine | 10 | 0.38 |
| 5 | 2,4,6-trichloropyrimidine | 10 | 0.59 |
| 6 | 2,4-dichloropyrimidine | 10 | 0.39 |
| 7 | pentachloropyridine | 10 | 0.41 |
| 8 | 4,6-dichloro-5-nitropyridine | 5 | 0.41 |
| 9 | 2,6-dichloropyridine | 2 | 0.59 |
| 10 | 2,6-dibromopyridine | 2 | 0.60 |
| 11 | 1-chloro-4-nitroisoquinoline | 2 | 0.60 |
| 12 | 2,6-dichloropyrazine | 2 | 0.78 |
| 13 | 2-chlorobenzo{b}phenazine-6,11-dione | 1 | 0.43 |
| 14 | 5-chlorobenzo{b}phenazine | 1 | 0.33 |
| 15 | quinoxaline | 2 | 0.73 |
| 16 | 2-chloroquinoxaline | 2 | 0.55 |
| 17 | 2,3-dichloroquinoxaline | 2 | 0.31 |
| 18 | 2,3,6-trichloroquinoxaline | 2 | 0.14 |
| 19 | 2,3,6,7-tetrachloroquinoxaline | 2 | 0.30 |
| 20 | 2,3-dichloro-6,7-dinitroquinoxaline | 2 | 0.80 |
| 21 | 2-chloro-3-methylquinoxaline | 2 | 0.53 |
| 22 | 2,3-diphenylquinoxaline | 2 | 0.38 |

EXAMPLES 23–26

Elements otherwise identical to those in the preceding examples were prepared using 1 percent, (by weight, based on anthracene) of the chemical sensitizer shown in Table II. Relative electrophotographic speeds of the resulting elements were determined by comparison with the electrophotographic speed of the above control, arbitrarily assigned a value of 100.

TABLE II

| Example | Chemical Sensitizer | Relative Electrical Speed |
|---|---|---|
| | None (control) | 100 |
| 24 | 2,3-di(p-acetoxystyryl)quinoxaline | 250 |
| 25 | 2,3-di(4-acetoxy-3-methoxystyryl)-quinoxaline | 163 |
| 26 | 2,3-di(p-methoxystyryl)quinoxaline | 344 |

The chemical sensitizers employed in examples 24–26 were also noted to extend the spectral sensitivity of their respective compositions into the blue visible light region.

EXAMPLE 27

Heterogeneous electrophotographic compositions were prepared as in the preceding examples containing 80 percent (by weight of photoconductor plus binder) p-terphenyl photoconductor particles, 20 percent cellulose nitrate binder, .01 percent (by weight of photoconductor) spectral sensitizer, and 1 percent (by weight of photoconductor) of either 2,3,6-trichloroquinoxaline or 2,3,6,7-tetrachloroquinoxaline chemical sensitizer. The resulting compositions, when coated and dried on an electrically conducting support, exhibited approximately an 80 percent increase in relative electrical speed compared to an otherwise identical control having no chemical sensitizer.

EXAMPLE 28

A control element and chemically sensitized elements were prepared as in preceding example 27 substituting for the cellulose nitrate a binder consisting of a copolymer of methylmethacrylate and methacrylic acid. The elements containing chemical sensitizer exhibited little or no increase in relative electrical speed compared to the control element. Similar results may be expected when the same substitution of binder materials is made in examples 1–26.

The invention has been described with particular reference to certain preferred embodiments thereof but it will be understood that variations and modifications can be effected within the spirit and scope of the invention.

What is claimed is:

1. An electrophotographic element comprising an electrically conducting support bearing thereon a layer of a heterogeneous photoconductive insulating composition comprising particles of an organic photoconductor compound selected from the group consisting of (a) fused carbocylic ring compounds, (b) polyphenyl compounds having the structure

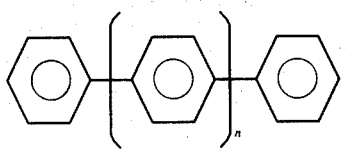

wherein $n$ is an integer from 1 to 6; and (c) nitrogen-free, polyarylated compounds having the structure

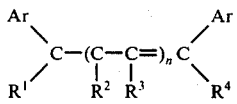

wherein $n$ is 0, 1, or 2 Ar is aryl; and $R^1$, $R^2$, $R^3$, and $R^4$ individually represent hydrogen, Ar, alkyl having 1 to about 10 carbon atoms, or alkoxy having 1 to about 10 carbon atoms, with the proviso that when $n$ is 0, both $R^1$ and $R^4$ are Ar, and when both $R^1$ and $R^4$ are hydrogen, both $R^2$ and $R^3$ are Ar, said photoconductor particles being dispersed in cellulose nitrate and chemically sensitized with a $\pi$-deficient N-heteroaromatic compound.

2. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 1.

3. An electrophotographic copy comprising an element as defined in claim 1 and a visible image pattern on said photoconductive insulating composition layer.

4. A heterogeneous photoconductive insulating composition comprising particles of an organic photoconductor compound selected from the group consisting of (a) fused carbocyclic ring compounds, (b) polyphenyl compounds having the structure

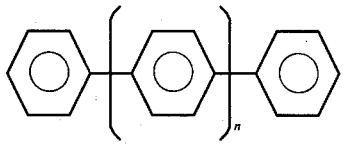

wherein $n$ is an integer from 1 to 6; and (c) nitrogen-free, polyarylated compounds having the structure

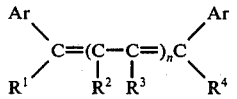

wherein $n$ is 0, 1, or 2 Ar is aryl; and $R^1$, $R^2$, $R^3$, and $R^4$ individually represent hydrogen Ar, alkyl having 1 to about 10 carbon atoms, or alkoxy having 1 to about 10 carbon atoms, with the proviso that when $n$ is 0, both $R^1$ and $R^4$ are Ar, and when both $R^1$ and $R^4$ are hydrogen, both $R^2$ and $R^3$ are Ar, said photoconductor particles being dispersed in cellulose nitrate and chemically sensitized with a $\pi$-deficient N-heteroaromatic compound.

5. The composition of claim 1 wherein said $\pi$-deficient N-heteroaromatic compound is a six-membered ring compound, or benzolog thereof.

6. The composition of claim 1 wherein said $\pi$-deficient N-heteroaromatic compound is present in said composition in a concentration from about 0.5 percent to about 10 percent, by weight of photoconductor.

7. The composition of claim 1 wherein said $\pi$-deficient N-heteroaromatic compound is present in said composition in a concentration from about 1.0 to about 3.0 percent, by weight of photoconductor.

8. A heterogeneous photoconductive insulating composition comprising particles of an organic photoconductor compound selected from the group consisting of (a) fused carbocyclic ring compounds, (b) polyphenyl compounds having the structure

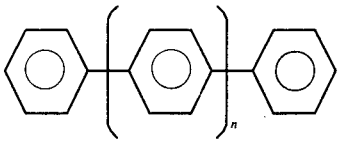

wherein $n$ is an integer from 1 to 6; and (c) nitrogen-free, polyarylated compounds having the structure

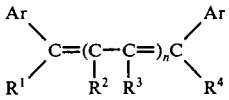

wherein $n$ is 0, 1, or 2 Ar is aryl; and $R^1$, $R^2$, $R^3$, and $R^4$ individually represent hydrogen, Ar, alkyl having 1 to about 10 carbon atoms, or alkoxy having 1 to about 10 carbon atoms, with the proviso that when $n$ is 0, both $R^1$ and $R^4$ are Ar, and when both $R^1$ and $R^4$ are hydrogen, both $R^2$ and $R^3$ are Ar, said photoconductor particles being dispersed in cellulose nitrate and chemically sensitized with a sensitizing compound which is a pyridine, a pyrimidine, a quinoline, a pyridazine, a pyrazine, a phenazine, or a quinoxaline.

9. The composition of claim 8 wherein said sensitizing compound is substituted with at least one electron withdrawing group.

10. The composition of claim 9 wherein said electron withdrawing group is a halo, nitro, or carbonyl group.

11. The composition of claim 8 wherein said sensitizing compound is: pyridine, 3,6-dichloropyridazine, pyrimidine, 2,4,6-trichloropyrimidine, quinoline, 2,4-dichloropyrimidine, pyridazine, 4,6-dichloro-5-nitropyrimidine, pyrazine, 2,6-dichloropyrazine, phenazine, 2,6-dibromopyridine, quinoxaline, 1-chloro-4-nitroisoquinoline, 2,3,6-trichloroquinoxaline 2,6-dichloropyrazine, 2,3,6,7-tetrachloroquinoxaline 2-chlorobenzo{b}phenazine-6,11-dione, 2,3-dichloro-6,7-dinitroquinoxaline, 2-chloroquinoxaline, 2-chloro-3,5-dinitropyridine, 2,3-dichloroquinoxaline, 5-chloro{a}• phenazine, 2-chloro-3-methylquinoxaline, 4,7-dichloroquinoline, or 2,3-diphenylquinoxaline.

12. A heterogeneous photoconductive insulating composition comprising particles of anthracene, p-terphenyl, p-quaterphenyl, or a tetraphenylbutadiene, dispersed in cellulose nitrate and chemically sensitized with a quinoxaline compound.

13. The composition of claim 12 wherein said quinoxaline is 2,3,6-trichloroquinoxaline or 2,3,6,7-tetrachloroquinoxaline, and the nitrogen content of said cellulose nitrate is from about 11.5 to about 13 percent.

14. The composition of claim 13 wherein said photoconductor is anthracene or p-terphenyl, and said quinoxaline is 2,3,6-trichloroquinoxaline.

15. A heterogeneous photoconductive insulating composition comprising particles of an organic photoconductor compound selected from the group consisting of (a) fused carbocyclic ring compounds, (b) polyphenyl compounds having the structure

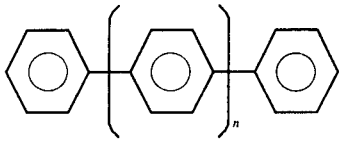

wherein $n$ is an integer from 1 to 6; and (c) nitrogen-free, polyarylated compounds having the structure

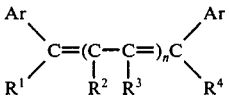

wherein $n$ is 0, 1, or 2 Ar is aryl; and $R^1$, $R^2$, $R^3$, and $R^4$ individually represent hydrogen, Ar, alkyl having 1 to about 10 carbon atoms, or alkoxy having 1 to about 10 carbon atoms, with the proviso that when $n$ is 0, both $R^1$ and $R^4$ are Ar, and when both $R^1$ and $R^4$ are hydrogen, both $R^2$ and $R^3$ are Ar, said photoconductor particles being dispersed in cellulose nitrate and chemically sensitized with a $\pi$-deficient N-heteroaromatic compound substituted with at least one styryl group.

16. The composition of claim 15 wherein said photoconductor is anthracene and said $\pi$-deficient N-heteroaromatic compound is 2,3-di(p-acetoxystyryl)-quinoxaline; 2,3-di(4-acetoxy-3-methoxystyryl)quinoxaline; or 2,3-di(p-methoxystyryl)quinoxaline.

17. An electrophotographic element comprising an electrically conducting paper support bearing thereon a layer of a heterogeneous photoconductive insulating composition comprising particles of an organic photoconductor which is anthracene or p-terphenyl dispersed in cellulose nitrate and chemically sensitized with a quinoxaline compound.

18. The electrophotographic element of claim 17 wherein said quinoxaline compound is substituted with one or more halo or nitro groups.

19. The electrophotographic element of claim 18 wherein said layer is present on said support in a solvent-free amount ranging from about 2 to about 15 grams per square meter, said photoconductor is p-terphenyl, and the nitrogen content of said cellulose nitrate is from about 11.5 to about 13 percent.

20. The electrophotographic element of claim 19 wherein said quinoxaline is 2,3,6-trichloroquinoxaline, and said composition additionally comprises a matte agent and a cyanine or benzopyrylium spectral sensitizer.

21. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 20.

* * * * *